US010618684B2

(12) United States Patent
Eckert et al.

(10) Patent No.: US 10,618,684 B2
(45) Date of Patent: Apr. 14, 2020

(54) BLANK FOR A RECLOSABLE CONTAINER

(71) Applicant: NESTEC S.A., Vevey (CH)

(72) Inventors: Sebastian Eckert, Frankfurt (DE); Rafael Schraml, Konolfingen (CH); Marco Vierling, Mainz (DE); Martin Zelosko, Wiesbaden (DE)

(73) Assignee: Societe des Produits Nestle S.A., Vevey (CH)

( * ) Notice: Subject to any disclaimer, the term of this patent is extended or adjusted under 35 U.S.C. 154(b) by 17 days.

(21) Appl. No.: 15/537,147

(22) PCT Filed: Dec. 17, 2015

(86) PCT No.: PCT/EP2015/080275
§ 371 (c)(1),
(2) Date: Jun. 16, 2017

(87) PCT Pub. No.: WO2016/097176
PCT Pub. Date: Jun. 23, 2016

(65) Prior Publication Data

US 2018/0265246 A1 Sep. 20, 2018

(30) Foreign Application Priority Data

Dec. 19, 2014 (EP) ..... 14199510

(51) Int. Cl.
*B65D 5/42* (2006.01)
*B65D 5/00* (2006.01)
(Continued)

(52) U.S. Cl.
CPC ..... *B65D 5/543* (2013.01); *B31B 50/20* (2017.08); *B31B 50/26* (2017.08); *B65B 5/024* (2013.01);
(Continued)

(58) Field of Classification Search
CPC .... B65D 5/543; B65D 5/0227; B65D 5/4266; B65D 77/02; B65D 5/6608; B65D 5/443;
(Continued)

(56) References Cited

U.S. PATENT DOCUMENTS 2,361,659 A * 10/1944 Smith ..... B65D 5/543 206/264
2,967,010 A 1/1961 Cuffey, Jr. et al.
(Continued)

FOREIGN PATENT DOCUMENTS

CN 104136332 A 11/2014
FR 2197774 3/1974
(Continued)

OTHER PUBLICATIONS

Chinese Office Action for corresponding Chinese Application No. 201580068088.3 dated Aug. 24, 2018, (15 pages).

*Primary Examiner* — Christopher R Demeree
(74) *Attorney, Agent, or Firm* — K&L Gates LLP

(57) ABSTRACT

The present invention relates to a blank for a flip-top container and a method for producing a blank for a flip-top container and a method of producing a flip-top container from a blank. A blank according to the present invention may preferably comprise a section for an outer body part and a section for an inner frame. The section of the blank for the outer body comprises two side panels, a front panel and a rear panel. Each side panel is typically connected to the front panel at opposite vertical folding lines; the rear panel is typically connected to one of the side panels along a vertical folding line. A scoring line is provided in the side panels and in the front panel; the scoring line extends downwardly sloping in the side panels towards front panel and extends horizontally in at least a part of the front panel. Each of the side panels, front panel and rear panel has a flap connected at an upper and at a lower horizontal folding line of the
(Continued)

panel. Further, the section of the blank for the inner frame comprising two inner side parts and an inner front part, wherein each inner side parts is connected to the inner front part at opposite vertical folding lines, and the inner front part comprising a flap connected at an upper horizontal folding line, said flap comprising a scoring line defining a flap part above the scoring line.

10 Claims, 6 Drawing Sheets

(51) Int. Cl.

| | |
|---|---|
| ***B65D 5/02*** | (2006.01) |
| ***B31B 50/26*** | (2017.01) |
| ***B65D 5/54*** | (2006.01) |
| ***B65D 77/02*** | (2006.01) |
| ***B31B 50/20*** | (2017.01) |
| ***B65B 5/02*** | (2006.01) |
| *B31B 100/00* | (2017.01) |
| *B31B 110/35* | (2017.01) |

(52) U.S. Cl.
CPC ..... *B65D 5/0227* (2013.01); *B65D 5/4266* (2013.01); *B65D 77/02* (2013.01); *B31B 2100/0024* (2017.08); *B31B 2110/35* (2017.08)

(58) Field of Classification Search
CPC ..... B65D 5/6691; B31B 50/20; B31B 50/26; B31B 2120/102; B65B 5/024
USPC .... 229/237, 126, 160.1, 225, 160.2, 122.32, 229/128; 493/162, 51, 79; 53/381.1
See application file for complete search history.

(56) References Cited

U.S. PATENT DOCUMENTS

| | | | | |
|---|---|---|---|---|
| 5,036,982 | A * | 8/1991 | Aston | B65D 5/543 229/160.1 |
| 5,511,722 | A | 4/1996 | Dixon | |
| 5,653,384 | A | 8/1997 | Shaikh | |
| 5,749,462 | A * | 5/1998 | Houghton | B65D 85/1045 206/268 |
| 7,523,825 | B2 * | 4/2009 | Velazquez | B65D 5/543 206/440 |
| 9,439,490 | B2 * | 9/2016 | DeGeorge | A45D 7/04 |
| 9,828,156 | B2 * | 11/2017 | McKenzie | B65D 75/5844 |
| 2003/0116614 | A1 | 6/2003 | Block et al. | |

FOREIGN PATENT DOCUMENTS

| | | |
|---|---|---|
| JP | 2006225007 A | 8/2006 |
| WO | 9220583 | 11/1992 |

* cited by examiner

BLANK FOR A RECLOSABLE CONTAINER

CROSS REFERENCE TO RELATED APPLICATIONS

The present application is a National Stage of International Application No. PCT/EP2015/080275, filed on Dec. 17, 2015, which claims priority to European Patent Application No. 14199510.0, filed on Dec. 19, 2014, the entire contents of which are being incorporated herein by reference.

FIELD OF THE INVENTION

The present invention relates to a blank for a flip-top container and a method for producing a blank for a flip-top container and a method of producing a flip-top container from a blank. A blank according to the present invention may preferably comprise a section for an outer body part and a section for an inner frame. The section of the blank for the outer body comprises two side panels, a front panel and a rear panel. Each side panel is typically connected to the front panel at opposite vertical folding lines; the rear panel is typically connected to one of the side panels along a vertical folding line. A scoring line is provided in the side panels and in the front panel. Each of the side panels, front panel and rear panel has a flap connected at an upper and at a lower horizontal folding line of the panel. Further, the section of the blank for the inner frame comprising two inner side parts and an inner front part, wherein each inner side parts is connected to the inner front part at opposite vertical folding lines, and the inner front part comprising a flap connected at an upper horizontal folding line, said flap comprising a scoring line defining a flap part above the scoring line.

BACKGROUND OF THE INVENTION

Containers with a hinged lid are often referred to as flip top boxes. Such flip top boxes are used for numerous storing purposes. One example of a flip top box is disclosed in WO 02/26571. The flip-top box disclosed therein is provided by folding a blank into a container which has a latching means between the body of the carton and the lid to latch the lid in a closed condition after use. The latching comprises a latching flap as a part of an additional inner or internal wall or panel and a catch member attached to the lid panel when the carton is assembled. The internal panel also has a panel which is attachable to the front wall and has lines of weakness. The carton blank has frangible membranes between the lid and the body of the carton which is severed on first opening of the carton to a tamper evident feature.

The latching means in WO02/26751 is formed by an extension of a container part (a latch part) attached to the front panel at the bottom and folded backwardly along a folding line. The bottom of the flip-top box of WO02/26751 is formed by folding three flaps (each connected respectively to the bottom of a side panel or a rear panel) resulting in that a slit-opening is provided along the bottom folding line in the front panel. Such a slit-opening is often undesired as it provides access to the interior of the container.

In addition, folding the blank disclosed in WO02/26751 to form a container has shown to be a delicate process inter alia as the latch part is attached to the front panel at the bottom and has to be folded twice: one time to arrange the latch part flush with inner surface of the front panel of the container, and one time to position an upper section of the latch part in between the inner surface of the front panel and the section of the latch part extending from the bottom and upwardly—this rendering it impracticable to produce containers from blank in a horizontal cartoning machine.

Thus, a container made from a blank as disclosed in WO/02/26751 may be difficult to produce and the container as such cannot be closed effectively in the bottom and top as the top and bottom both are provided with slit-opening.

While current containers of the flip top box type find great use, they often also suffer from the drawback of being difficult to re-close. The difficulties experienced is inter alia, that when the lid is rotated towards its closing position, the closing operation may become obstructed by the elements of the container which are intended to be situated inside lid after closing blocking the passage of the lid towards its closing position.

Hence, an improved blank would be advantageous, and in particular a blank from which a container providing a more efficient and/or reliable reclosing of the container would be advantageous.

It would also be advantageous to provide a blank for a flip-top container, which would be easily folded using a horizontal cartoning machine.

OBJECT OF THE INVENTION

It is also an object of the present invention to wholly or partly overcome the above disadvantages and drawbacks of the prior art. More specifically, it is an object to provide a blank which upon folding may result in a container which provides efficient and/or reliable reclosing and which can be folded using a horizontal cartoning machine.

SUMMARY OF THE INVENTION

Thus, the above described objects and several other objects are intended to be obtained in a first aspect of the invention by providing a blank for a container comprising an outer body part and an inner frame.

The section of the blank for the outer body comprises two side panels, a front panel and a rear panel. Each side panel is connected to the front panel at opposite vertical folding lines and the rear panel is connected to one of the side panels along a vertical folding line. A scoring line is provided in the side panels and in the front panel. Preferably said scoring line extends downwardly sloping in the side panels towards front panel and the said scoring line extends horizontally in at least a part of the front panel.

When the blank is folded into a container, the parts above the scoring lines in the side panels and the front panels constitute sides and front of the lid. The scoring lines may be perforation lines each comprising a row of perforations which are to be broken to enable opening of the lid. Hereby a container is obtained in which the openable lid is obtained by manually breaking the perforations as part of the first opening of the container. This means that no further closure means are needed to keep the container closed after filling and until use.

Further, each of the side panels, front panel and rear panel has a flap connected at an upper and at a lower horizontal folding line of the panel.

The section of the blank for the inner frame comprises two inner side parts and an inner front part. Each inner side parts is connected to the inner front part at opposite vertical folding lines and the inner front part comprises a flap connected at an upper horizontal folding line. The flap of the inner front part comprises a scoring line extending horizontally across the flap defining a flap part above the scoring line.

When the blank is folded into a container, the flap part above the scoring line is adhered, such as glued, to the inner surface of the lid and upon an initial opening of the lid, the flap breaks along the scoring line, leaving the flap part on the lid and providing a outwardly and downwardly protruding part on the inner front part. This will provide an easy re-closing and a latch as presented in further details below.

The blank further comprises an intermediate part being connected to one of the inner side parts and to the rear panel along a vertical folding line.

By the provision of, inter alia, the inner frame with the flap connected at an upper horizontal folding line, an easy closing mechanism is provided which at the same time allows for a more efficient closed bottom of the container as the bottom is formed by four flaps each connected at lower horizontal folding lines of the front, the side panels and the rear panel.

A number of terms are used herein in a manner being ordinary to a skilled person. Some of these words are explained in further details below:

In the present invention, orientations are used such as side, front, rear, up, down. Such orientations are preferably used as presented in the figures; however, the orientation of the container—and therefore also the various orientations referenced—is chosen so that the lid is on top of the container, rear is typically defined as the position where the lid is connected when the lid is opened. Front is opposite to rear, and side is in-between front and rear.

Connected to as used e.g. in "each of the inner side parts is connected to the inner front part" typically refers to the situation where the two parts are not are joined by two separate pieces but instead that they are distinguishable from each other by e.g. a folding and/or scoring line. However, within the scope of the invention is considered that the two parts may be two separate pieces joined.

Panel is preferably used to mean a section of a container e.g. bordered by folding lines at least along a part of the panels perimeter. Panel is also used in a broad sense to mean a sheet of material. In case of cubic shaped container, this means that each part comprising a surface of the cube is typically considered to be a panel.

Blank is preferably used to mean an element ready to be folded into the container.

Scoring line is preferably used to mean a line along which through going cuts are provided intermittently. Thereby, two elements divided by a scoring line may be moved apart by pulling which results in breaking of the material along the scoring line.

A folding line may preferably be provided in rear panel. Such a folding line extends typically horizontally between the vertical folding lines at which the rear panel is connected to a side panel and the intermediate part, and extends at the horizontal position of said side panel's scoring line's intersection with said folding line. Such a folding line, when applied, will define the line along which the lid rotates during opening or closing of a container made from a blank according to the present invention.

Preferably, the flap of the inner front part is trapezoid shaped with the shorter horizontal line defining an outer edge in the blank.

Preferably, the upper margins of the inner side parts extends downwardly sloping from the vertical folding lines at which the inner side parts are connected to inner front part.

The upper most part of each of the upper margins of the inner side parts preferably extends above the scoring line in the side panel.

As presented herein, the blank is preferred to be a flat element in the sense that the blank is not folded and extends along flat plane. A blank according to the present invention may be made from a number of materials including metal, plastic, paper, cardboard or combinations thereof. In a preferred embodiment the blank according to the present invention is made of cardboard, such as a GC cardboard or a GD2 cardboard.

At least two parallel and spaced apart transverse cuts may preferably be provided at or near a central part of the folding line in the rear panel. Such transverse cuts perforate the rear panel through the thickness, and the transverse cuts extend substantially symmetrically across and perpendicular to the folding line. Preferably folding lines connect the ends of the transverse cuts.

In some embodiments of the invention, embossing lines connect the ends of the transverse cuts. Embossing may also be provided along the folding line in the rear panel. Such embossing is typically provided in the material from which the container is made in order to facilitate the desired folding of the material during opening of the lid. The embossing may e.g. be made by the die cutting tool used to make the sheet material from which the container is typically made.

The number of the transverse cuts may be two, and they are then typically arranged symmetrically around a midpoint of the folding line. The length of the transverse cuts may depend on the size of the container, and an optimal length can be determined e.g. from experiments. Possible total lengths are 20 to 40 mm, such as 20 to 30 mm or 30 to 40 mm.

A container as described above may further comprise an end cut provided near but at a distance from each end of the folding line, the end cuts going through the thickness of the rear panel, and the folding line being perforated between the end cuts and the end of the folding line adjacent to the side panels. The presence of such end cuts have shown to further minimize the risk of damage at the ends of the folding line, because the forces are spread over a larger area and in different directions instead of only one. The end cuts may extend substantially symmetrically across the folding line.

Each of the end cuts may be provided in the form of two linear and coherent sub-cuts arranged non-perpendicular to the folding line. The angle between the coherent sub-cuts may be between 90° and 175°, such as between 100° and 170°, such as between 110° and 150°, such as between 120° and 130°, such as 125°. Alternatively the sub-cuts may be along one line and thus be perpendicular to the folding line; i.e. having an angle of 180°. In an alternative embodiment, the end cuts may be arc-shaped. Exactly which design of the end cuts to use for a given design of a container, including the type and thickness of the material used, can be determined e.g. by experimentation.

In some embodiments of the invention, the folding line may further comprise a row of discontinuous perforations extending along the folding line. This has been found to reduce the re-closing force when the container has been opened. These perforations may further ease the first opening of the lid along the folding line and thereby reduce the risk of bulging which could otherwise induce damage to the folding line as described above.

In a preferred embodiment, each of the scoring lines in the side panels is a row of perforations each comprising two coherent first and second cuts with a blunt angle there between. These perforations may preferably be arranged to provide a row of tooth-shaped regions where each tooth-shaped region is delimited by a first cut and a second cut, respectively, from two mutually adjacent but non-coherent perforations. Further, the first cuts are preferably arranged parallel to each other but staggered so that they are not arranged along one line.

Preferably, tips of the tooth-shaped regions may preferably be directed towards the rear panel. By "tip" is preferably meant the narrowest end of a tooth-shaped region, i.e. at the end where the distance between to two adjacent perforations is smallest.

Further or alternatively, the blunt angle between first and second cuts of the perforations in the side panels may preferably be between 145° and 175°, such as between 155° and 165° or between 165° and 175°.

The smallest distance between two perforations on the side panels may be between 0.5 and 3 mm, such as between 1 and 2 mm, preferably approximately 1 mm. This distance is preferably to be taken as the smallest distance when measured perpendicular to a first cut of a perforation towards the adjacent perforation. Exactly which distance to choose for at given application will depend on a number of parameters including the thickness and tear strength of the material from which the container is made, the width of the cuts and the overall inclination angle of the perforation lines with respect to horizontal.

The length of the first cuts of the perforations on the side panels may be between 8 and 16 mm, such as 10 to 14 mm, such as 11 to 13 mm.

The blanks may advantageously be stacked prior to folding into a container. Such a stack of blanks may preferably comprise a plurality of blanks according to first aspect of the invention, wherein the plurality of blanks are stacked on top of each other and have a spatial orientation identical to each.

In a second aspect, the invention relates to a method of producing a blank according to the first aspect. Such a method comprises providing a sheet of material having an outer size larger than the outer contour of the blank, cutting the outer contour of the blank, embossing the folding lines to the blank and cutting the scoring lines.

Preferably the cutting is carried out as a stamping. In addition, the method of producing a blank may comprise the step of applying a print to the surface of the blank prior to folding of the blank.

In a third aspect, the invention relates to a method of producing a content containing container from a blank according to the first aspect. The method preferably comprises a step of providing a blank which preferably may be made by the method according to the second aspect of the invention. It is noted that the sequence in which steps below are arranged represents a preferred sequence and that the steps may be arranged differently.

The method of providing a container from a blank may preferably comprise the steps of applying adhesive onto the flaps connected to the rear panel, the intermediate part and along the vertical margin of the inner side part forming an outer margin of the blank.

Thereafter, the inner frame is folded by folding along the vertical folding lines at which the inner side parts are connected to the inner front part by an amount of 90° and subsequently folding the outer body part around the folded inner frame by folding by an amount of 90° along the vertical folding lines of the outer body part. The flap is folded 180° along the folding line along which the flap is connected to the inner front part.

After the folding of the inner frame and the body part, adherence of the side panel forming an outer margin of the blank to the intermediate part, and adherence of at least a section of the flap part to the inner surface of the front panel are performed.

Following the steps of adhering, the flaps are folded along the folding lines to form a bottom panel and a top panel of the container.

The method also comprises the step of arranging a pouch or another content inside the container prior to providing the bottom panel (2) and/or the top panel (6). Accordingly, the content may be arranged when the bottom and top are not yet formed (are open) or when only the top or the bottom is not yet formed (is open).

Thus, in the third aspect, the method of producing a content containing container further comprises the steps of:

arranging content into a container produced from a blank according to any of the preceding claims, which blank is folded to form the outer body part and the inner frame, with the flaps of respectively the side panels, the front panel and the rear panel being unfolded, and the flap of the inner front part being folded 180° along the folding line along which the flap is connected to the inner front part and adhered to the inner surface of the front panel, folding the flaps along the folding lines to form a bottom panel and a top panel of the container, and adhering the two outer most flaps of respectively the bottom and top panel together.

Preferably, the content arranged in the container is contained in a pouch which is arranged in the container.

Further embodiments, details and aspects are presented below as well as in the claims.

BRIEF DESCRIPTION OF THE FIGURES

The present invention will now be described in more detail with regard to the accompanying figures. The figures show one way of implementing the present invention and are not to be construed as being limiting to other possible embodiments falling within the scope of the attached claim set.

DETAILED DESCRIPTION OF PREFERRED EMBODIMENTS

Figure 1:
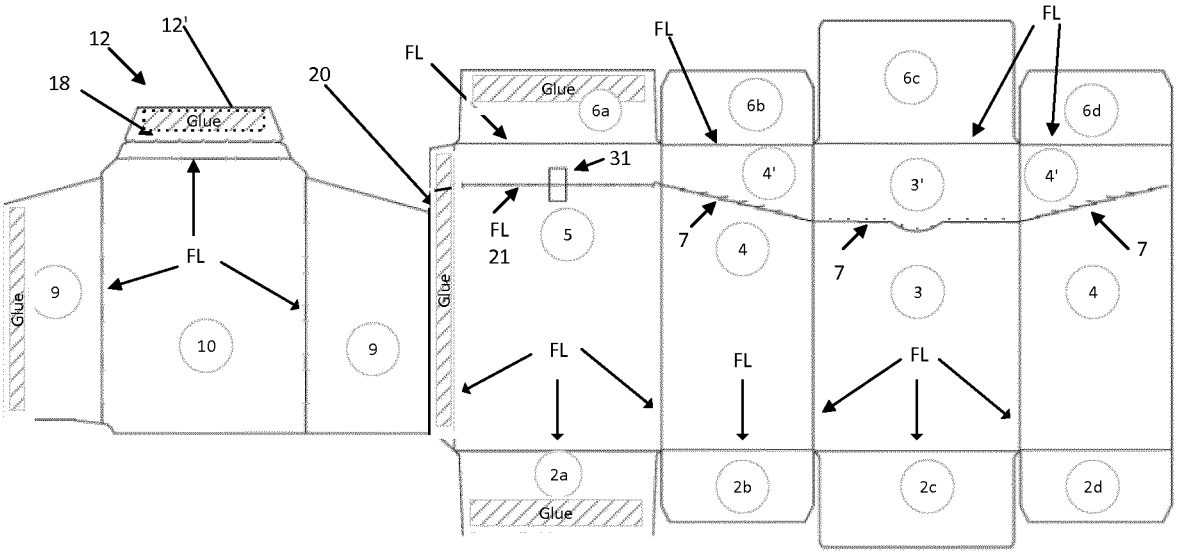
FIG. 1 illustrates a blank according to a preferred embodiment of the present invention.

FIG. 1 discloses a blank from which a container according to the present invention can be produced by folding the blank. In FIG. 1, the scoring line 7 is shown by a line with hatching in order to distinguish this line from folding lines, which each is referenced "FL" in FIG. 1. The panels 3, 4, 5 are shown with reference numerals in circles. The bottom panel 2 is formed by the four flaps 2*a*, 2*b*, 2*c*, 2*d* below the panels 3 and marked with reference numerals in circles, 4, 5, and the top panel 6 is formed by the flaps 6*a*, 6*b*, 6*c*, 6*d* above the panels 3, 4, 5. As shown in FIG. 1, the inner front section 10 and the inner side sections 9 are made integral with the other parts of the blank. In FIG. 1, it is shown that glue is used to keep the folded container assembled; however, welding may also be used instead or in combination with glue.

As presented above, a container made from a blank according to the present invention may be seen as comprising an outer body part and an inner frame. The outer body part comprises the side panels 4, the front panel 3, the rear panel 5, the top panel 6 and bottom panel 2. The inner frame comprises the inner front part 10 and the inner side parts 9. With reference to FIG. 1 a blank for a container comprising an outer body part and an inner frame is disclosed in the following.

The sections of the blank for the outer body comprise the two side panels 4, the front panel 3 and the rear panel 5. As depicted, each of the side panels 4 is connected to the front panel 3 at opposite vertical folding lines FL, and the rear panel 5 is connected to one of the side panels 4 along a vertical folding line FL. As shown in this configuration the vertical margin of one of the side panels 4 constitutes a part of the outer margin of the blank.

Further, each of the side panels 4, the front panel 3 and rear panel 5 has a flap 6*a*, 6*b*, 6*c*, 6*d*, 2*a*, 2*b*, 2*c*, 2*d* connected at an upper and at a lower horizontal folding line of the panels. Thereby, the margin of the flaps (not connected to the panels) constitutes a part of the outer margin of the blank.

The sections of the blank for the inner frame comprise the two inner side parts 9 and the inner front part 10. Each of the inner side parts 9 is connected to the inner front part 10 at opposite vertical folding lines. Further, the inner front part 10 comprises a flap 12 connected at an upper horizontal folding line.

In addition, the blank comprises an intermediate part 20 being connected to one of the inner side parts 9 and to the rear panel 5 along a vertical folding line.

Figure 2:
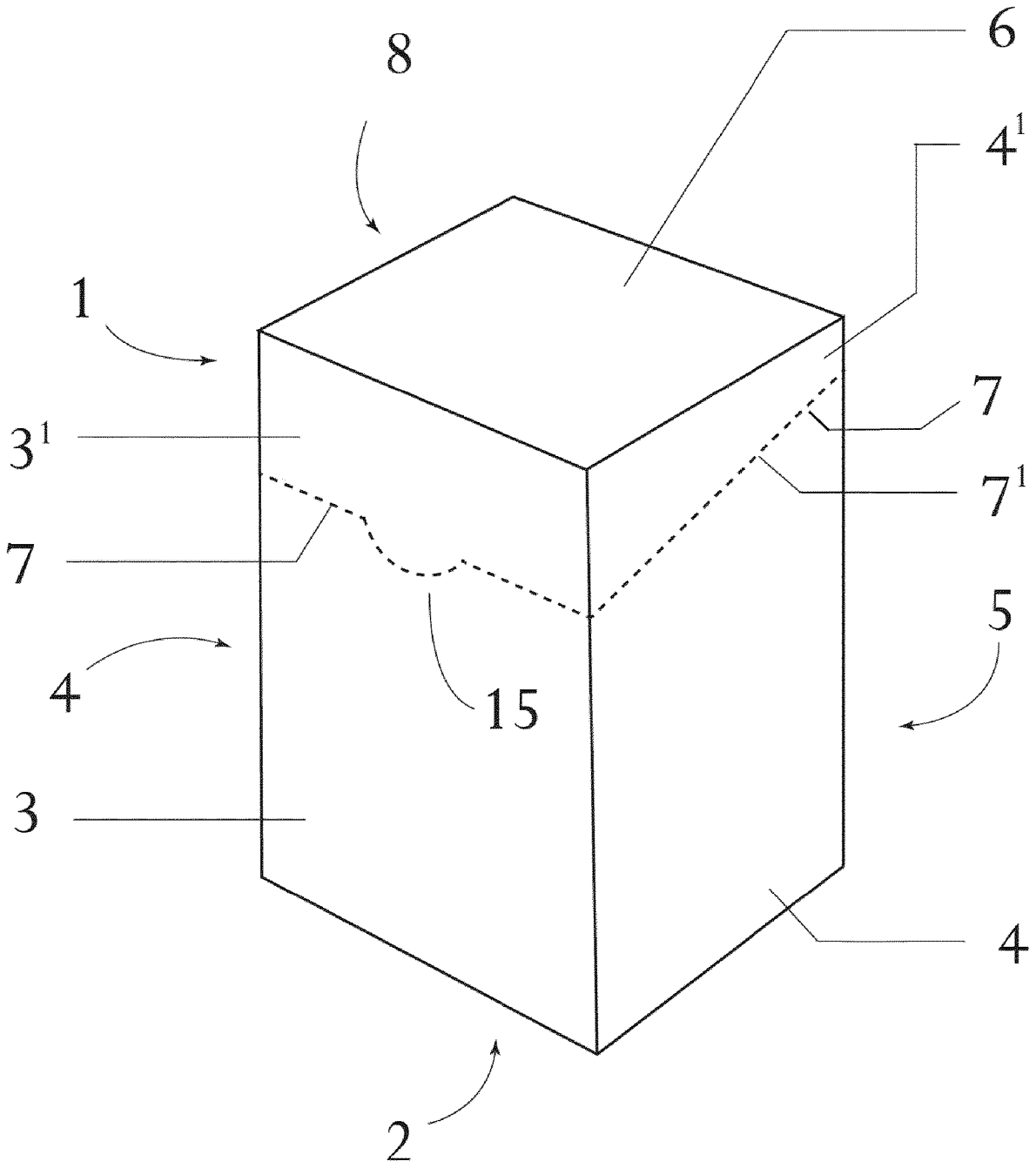
FIG. 2 is a perspective and schematic illustration of a container made from a blank and a method according to a preferred embodiment of the invention, the container is illustrated in a closed configuration.

Thus, as shown by the configuration shown in FIG. 1, the blank does not contain any excess material and constitutes an unbroken element which upon folding may provide a container e.g. as in FIG. 2.

As shown in FIG. 1, a scoring line is provided in the side panels 4 and in the front panel 3. This scoring line extends downwardly sloping in the side panel 4 towards front panel 3 and extends horizontally in at least a part of the front panel 3. Comparing this progression of the scoring line with the container shown in FIG. 2, it is seen that upon folding of the side panels 4 backwardly 90°, that it resembles the scoring line 7 shown in FIG. 2.

Further, a folding line may be provided in rear panel 5. This folding line extends horizontally between the vertical folding lines at which the rear panel is connected to a side panel 4 and the intermediate part 20, and extends at the position of the intersection between the scoring line in side panel 4 and said folding line. Again, when comparing with FIG. 2 this folding line resembles the one in FIG. 2, around which the lid rotates during opening and closing.

Figure 4A:
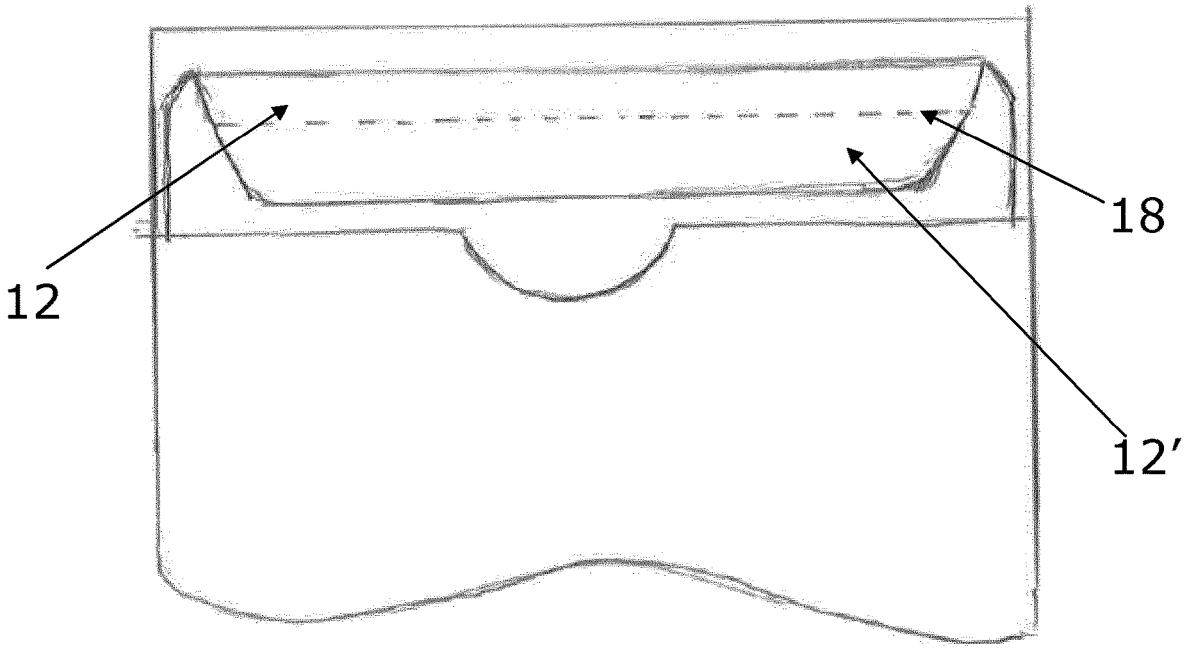
FIG. 4 is a close-up perspective and schematic illustration of a section of the container of FIG. 2; the section is shown with some material removed to reveal a part of the interior container.

The flap 12 provided on the inner front part 12 has a scoring line 18 which extends horizontally across the flap thereby defining a flap part 12' above the scoring line 18. Upon folding of the container, the part 12' is fastened to the inside of the lid 8 (positioned at the inside of section 3') and thus forms the ledge 14, as depicted in FIG. 4.

The flap 12 including the flap part 12' is trapezoid shaped with the shorter horizontal line defining an outer edge in the blank as presented in FIG. 1.

Figure 3:
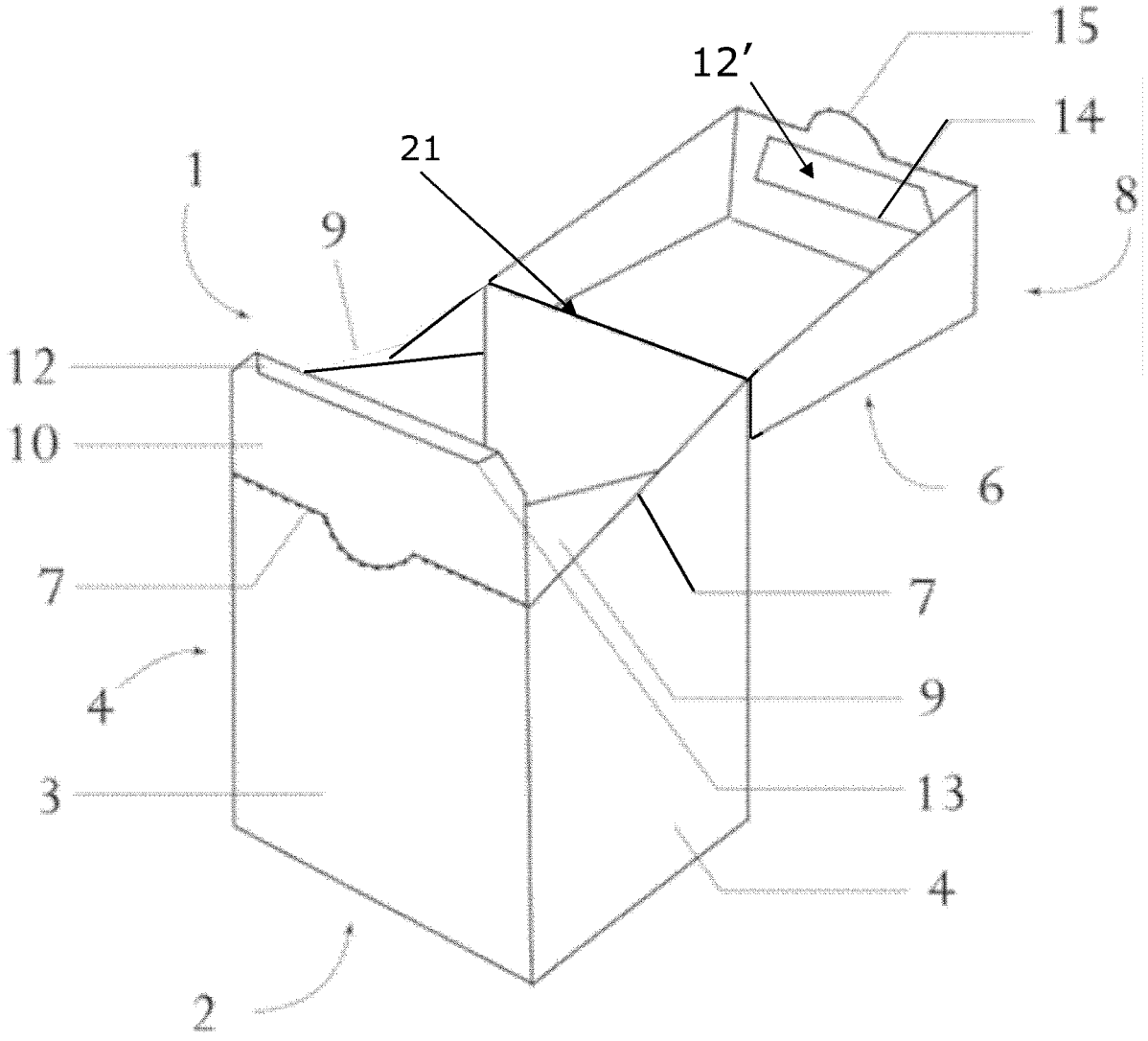
FIG. 3, is a perspective and schematic illustration of the container of FIG. 2 in an open configuration.

The upper margins of the inner side parts 9 extend downwardly sloping from the vertical folding lines at which the inner side parts 9 are connected to inner front part 10. And, when the upper most part of each the upper margin of the inner side parts extends above the scoring line 7 (as presented in FIG. 1) in the side panel 4, the upper margins of the inner side parts 9 extend above scoring line as shown in FIG. 3, when the blank is folded into a container.

As shown in FIG. 1 the blank is flat.

The blank is in preferred embodiments made from a so called GD2 carton which has the characteristics: WLC (White Lined Chipboard), CCN (Clay Coated News), CNB (Coated News Back) Pigment coated recycled carton board with special volume (>1.4 $cm^3/g$).

Reference is made to FIG. 2 which illustrates schematically and in a perspective view a reclosable container 1 made from a blank and a method according to a preferred embodiment of the present invention. As illustrated, the container 1 comprises a bottom panel 2, a front panel 3, two side panels 4, a rear panel 5 and a top panel 6. The panels of the container are preferably flat sheets of material, which panels are connected to each other at folding lines (as disclosed below).

The container 1 comprises a lid 8 which is provided by sections of the front panel 3 and the two side panels 4 above a scoring line 7 and a section of the rear panel 5 above a folding line provided in the rear panel. As presented in the figure, the scoring line 7 (dotted line) extends from the edge between the side panel 4 and the rear panel 5 along the side panel 4, continues across the front panel 3 and to the edge between the opposite side panel 4 and the rear panel 3. As also visible in FIG. 2, the scoring line 7 extends downwardly sloping from the rear panel 5 in the side panels 4 and horizontally in at least a part of the front panel 3. It is noted that the scoring line in the side panels 3 may extend in a direction being different from downward sloping (although that is preferred), and extend e.g. horizontally or even upwardly sloping.

As no scoring line 7 is provided in the rear panel 5, the lid is not separated from the container upon opening and the lid 8 is moveable by rotation along the folding line 21 in the rear panel 5. It is noted, that the scoring line 7 may also extend into the rear panel, but not in a manner or an extent so that the lid is separated from the rear.

The folding line 21 in the rear panel 5 may be provided prior to a first opening of the lid 8, e.g. by embossing during production of the container, or it may be provided by the action of the first opening of the lid 8. As the lid 8 may be folded backward more the 90 degrees, the lid 8 may stay open without any need for retaining it. In FIG. 2, the lid is shown in its open position.

In order to provide an easy reclosing of the container 1, the front panel 3 further comprises (see FIG. 3) an inner front part 10 extending above the scoring line 7 in the front panel 3 without being attached to the front panel 3 above the scoring line 7; the inner front part 10 further comprising a downwardly protruding flap 12 which will be disclosed in details below. Further, each side panel 4 comprises an inner side part 9 extending above the scoring line 7 in the side panel 4 without being attached to the side panel 4 above the scoring line 7. Advantageously, the upper margin of each of the inner side parts 9 extends downwardly sloping towards the rear panel 5, as shown in FIG. 3. This downward sloping towards the rear panel 5 may be seen as providing a guide which reduces the risk of unintentional engagement of the sections 4' with inner side part 9 during closing of the container 1.

While the inner side part 9 reduces the risk of un-intentional engagement of the sections 4', the section 3' may still be prone to un-intentional engagement with the inner front part 10. In order to reduce this risk, the inner front part 10 comprises a flap 12 (see FIG. 3) extending downwardly from an upper margin of the inner front part 10. This flap 12 is arranged so that it abuts an inner surface of the section 3' of the front panel 3 above the scoring line 7 when the lid 8 is in the position where it closes the container 1. In the situation, where the lid 8 is in the position where the container is open, the flap 12 extends downwardly and outwardly, where the outwardly extending typically is provided by the material being resilient and the flap is provided by folding along a folding line which after folding is the upper margin of the inner front part 10.

Accordingly, when the lid 8 is moved from the position shown in FIG. 3 to the position shown in FIG. 2, the upper margins of the inner side parts 9 will guide the sections 4' outwardly and/or the sections 4 will guide the inner side parts 9 inwardly during the first part of a closing operation. When the closing operation is at the stage where the section 3' meets the inner front part 10, the flap 12 (which extends outwardly and downwardly) will guide the section 3' outwardly and/or the inner front section 10 inwardly. Thereby an easy reclosing of the container 1 is provided.

Figure 4B:
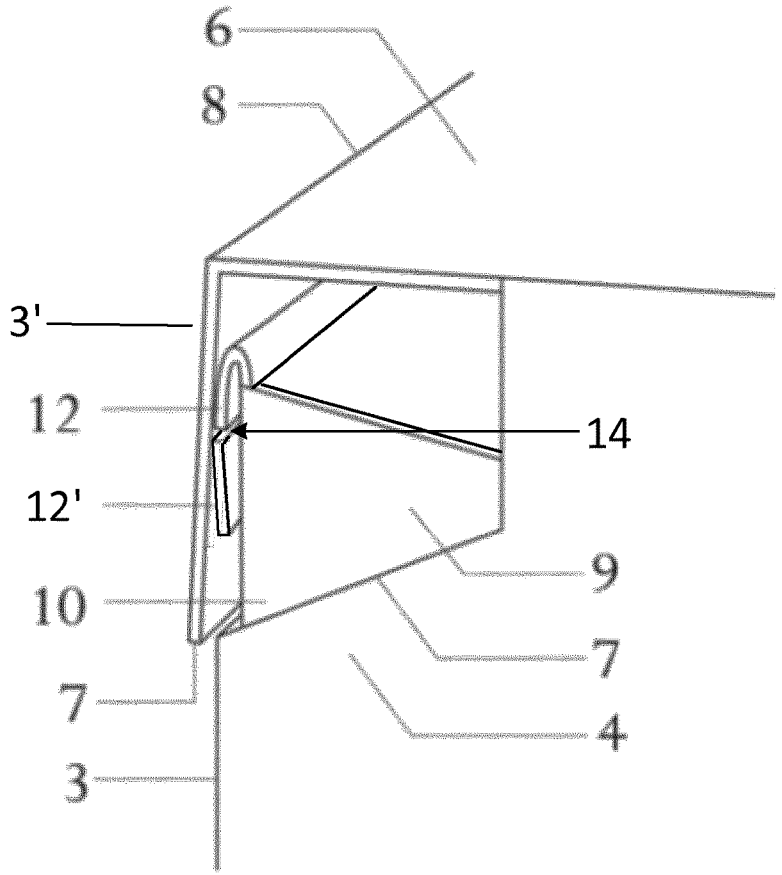

The container is prevented from being opened un-intentionally by a locking mechanism, which locking mechanism should preferably provide a tactile and/or a hearable response to inform the user that the container is closed and locked. Reference is made to FIG. 4 showing which illustrates such a locking mechanism. Upon a first opening of the lid 8, a ledge 14 is provided on the inner surface of the section 3' of the front panel 3 above the scoring line 7 in a position where the lower margin of the downwardly extending flap 12 engages with ledge 14, when the lid 8 is in the position where it closes the container 1. As illustrated in particular in FIG. 4B, the ledge 14 is provided by the flap part 12' of the flap 12 and is provided upon an initial first opening of the container as the flap part 12' is separated from the flap 12 along the scoring line 18 as the flap part 12' is adhered to the inside of the lid section 3'. Thus, the position pointed at by the arrow designating the ledge 14 in FIG. 4B is the position of the scoring line 18 prior to initial first opening of the container 1.

Thereby, the flap 12 will, when the lid 8 is to be positioned in the closed position, bend inwardly and/or the section 3' will bend outwardly until the flap 12 is able to bend outwardly. This may provide a snapping of the flap 12 which depending on the strength of the material used for the container provide a hearable and/or a tactile snap. The position at which the container is locked is shown in FIG. 4*b*, which illustrate the interior of the container at an upper corner with a part of the section 4' cut away for illustration only.

The scoring line (18) is in general constituted by a local weakening of the material along the line which weakening will provide a kind of tear open of the container along the line when a force is applied to the parts forming the flap (12) the during the initial opening operation; the weakening is typically of such a kind that the container may be opened by hand without requiring any kind of tools.

A downwardly protruding tongue 15 may be provided in the lid 8. This tongue is in the embodiment shown in the figures provided by the scoring line 7 in the front panel 3 curve downwardly in between two substantial straight parts, and the section 3' of the front panel 3 above the scoring line 7 comprising a downwardly protruding tongue 15 resembling the curvature of the scoring line 7. This tongue 15 provides an intuitive starting point to push inwardly in order to provide an initial brake of the scoring line 7 when the container is opened for the first time—at later openings, the tongue 15 may also serve as a flap that can be gripped during opening. Further, the tongue 15 may also co-operate with the flap 12 to further enhance an easy reclosing of the container 1.

The container 1 may advantageously be made from paper, cardboard and/or plastic.

Although other shapes than box-shape of a container 1 is possible, the box shape may be preferred in many instances. Such box-shape containers have horizontal and vertical rectangular cross sections as shown in the figures.

Figure 5:
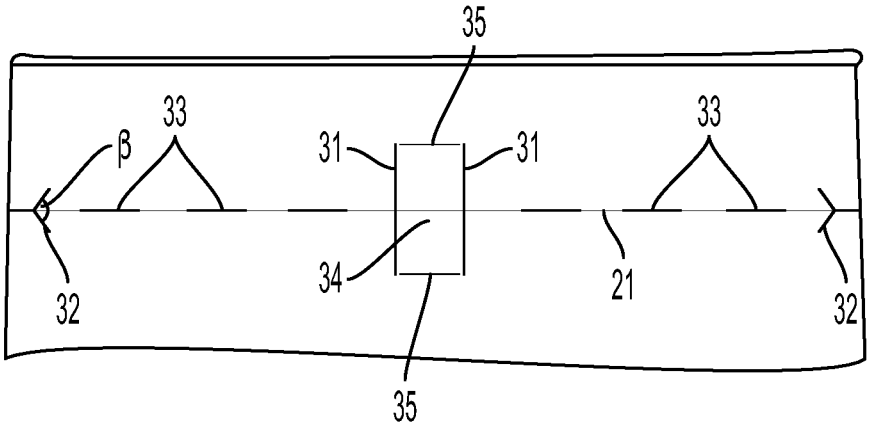
FIG. 5 is a photograph which illustrates a rear view of the folding line of a closed container made from a blank according to a preferred embodiment of the present invention.

FIG. 5 shows an example of a container provided from a blank according to the present invention, where the container is illustrated as seen from the rear side. As shown in FIG. 1 as well as in FIG. 3, the blank comprises a folding line 21 in the rear panel 5. In preferred embodiments, the scoring lines 7 provided in the side panels 4 extends into the rear panel and terminates at two end cuts 32 (as represented in FIG. 5) provided in the rear panel 5, which end cuts 32 are arranged near but at a distance from each end of the folding line 21. Typically, each of the end cuts 32 are coherent. These end cuts 32 go through the thickness of the rear panel 5. Further and as shown in FIG. 5, the folding line 21 may be provided with perforations 33. Each of the end cuts 32 preferably extends substantially symmetrically across the folding line 21. As shown in FIG. 5, the end cuts 32 have an angle (β) between the coherent sub-cuts, which angle is typically between 90° and 175°, such as between 110° and 160°, such as 125°.

As can be seen from FIGS. 4 and 5, a blank according to the present invention may comprise at least two parallel and spaced apart transverse cuts 31 provided at or near a central part of the folding line 21 in the rear panel 5. These transverse cuts 31 perforate the rear panel 5 through the thickness of the rear panel 5 and the transverse cuts 31 extend substantially symmetrically across and perpendicular to the folding line 21. Further, folding lines 35 connect the ends of the transverse cuts 31.

Figure 6:
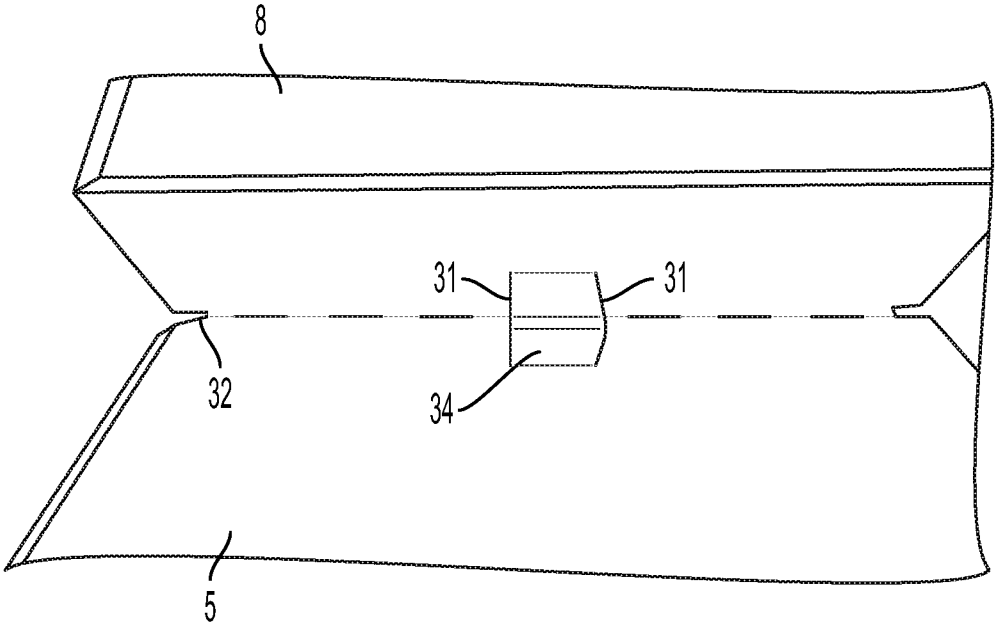
FIG. 6 is a photograph which illustrates a rear view of the folding line of an open container made from a blank according to a preferred embodiment of the present invention.

The effect obtained by the transverse cuts 31 is shown in FIG. 6 in which the lid of the container is in an open position and the container is illustrated as seen from the rear side. As shown, the two transverse cuts 31 form a region 34 between the transverse cuts 31 which bends in the opposite direction, i.e. out of the plane of the paper, as compared to the rest of the folding line 21. This has shown to avoid or at least mitigate buckling of the rear panel 5 during opening of the container. The effect is found to be further improved by the folding lines 35.

Figure 7:
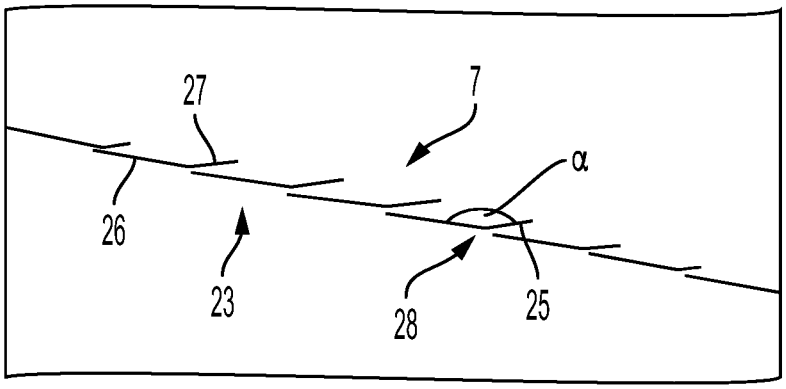
FIG. 7 is a photograph that shows an example of a scoring line on the side panels of the container in FIG. 1; the scoring line having tooth-shaped regions.

Reference is made in particular to FIG. 7 which illustrates particular preferred embodiments wherein each of the scoring lines 7 in the side panels 4 is a row of perforations 23 each comprising two coherent first and second cuts 26, 27 with a blunt angle (a) there between. These perforations are arranged to provide a row of tooth-shaped regions 25, where each tooth-shaped region 25 is delimited by a first cut 26 and a second cut 27, respectively, from two mutually adjacent but non-coherent perforations 23. The first cuts 26 are arranged parallel to each other but staggered so that they are not arranged along one line. The tips of the tooth-shaped regions 25 are directed towards the rear panel 5.

The blunt angle ($\alpha$) between first and second cuts 26, 27 of the perforations 23 in the side panels 4 is preferred to be between 145° and 175°, such as between 155° and 165° or between 165° and 175°.

As presented herein, a container is made from a blank according to the present invention, and such a blank comprises a section forming the inner frame and the outer body part of the container. In order not to limit the space unnecessarily, the dimension in the blank is chosen such the inner frame fits snugly inside the outer body part.

In often occurring situations the blank is produced at one location, and transported to another location where the blanks are folded into containers. In order to use less space during production, a plurality of blanks according to the present invention are stacked in a linear manner wherein blanks have a spatial orientation identical to each other and are placed on top of each other.

Blanks may be produced by providing a sheet of material having an outer size larger than the outer contour of the blank, cutting the outer contour of the blank, embossing the folding lines to the blank and cutting the scoring lines.

The cuttings may be carried out as a stamping.

Often the container is required to contain printed information, and such printed information may advantageously be provided to the surface of the blank prior to folding the blank into a container. It is noted that the printing may be provided prior to the cutting and embossing or after the cutting and embossing.

A container according to the present invention may advantageously be provided by the following steps after a blank has been provided.

Initially an adhesive is applied onto the flaps 2*a* and 6*a* connected to the rear panel 5, the intermediate part 20, and preferably along the vertical margin of the inner side part 9 forming an outer margin of the blank. This is shown in FIG. 4 with hatched regions designated "glue". Further, an adhesive is applied onto the flap 12 above the scoring line 18 (section 12' of the flap 12) on the surface facing opposite the surfaces of the flaps 2*a*, 6*a* being applied with adhesive—please note that the glue applied to the flap part 12' is shown with a hatched contour as the glue is applied to the back side (as seen in FIG. 4) of the blank.

Thereafter, the inner frame is folded by folding along the vertical folding lines at which the inner side part (9) are connected to the inner front part (10) by an amount of 90°. This folding will provide an inner frame having a concave cross section.

After the inner frame has been folded, the outer body part is folded around the folded inner frame by folding by an amount of 90° along the vertical folding lines of the outer body part. The end result of this will be a tubular structure.

Finally, the side panel (4) forming an outer margin of the blank is adhered to the intermediate part (20), whereby the tubular structure is fixed.

The tubular structure is then closed at the ends by folding the flaps along the folding lines to form a bottom panel 2 and a top panel 6 of the container.

It is noted, that the above adherence is disclosed with reference to a particular preferred embodiment and that glue may be provided to e.g. along the margin of the side panel 4 instead of along the margin of the inner side part 9—or even at both positions. Similarly, the position where glue (or in general) adhesive is applied may be reverted with respect to the flaps. Furthermore, in case of adhering by e.g. welding, no adhesive may be needed.

With respect to the bottom panel 2 and the top panel 6, it is seen that the folding may typically comprise a four layered weaved construction where the order (outside-in) of the layers of flaps is 2*d*, 2*a*, 2*c*, 2*b*, with the flaps 2*d* and 2*a* adhered to each other. Thus, the two flaps 2*a* and 2*d* are the two outer most flaps of the bottom panel 2 and, respectively, the two flaps 6*a* and 6*d* are the two outer most flaps of the top panel 6.

During the process of folding the blank, the flap 12 is folded 180° along the folding line along which the flap 12 is connected to the inner front part 10, so that the surface of flap 12 faces the inner side of the front panel 3 when the blank is folded into a container. Further, a part 12' of flap 12 is adhered to the inner surface of the front panel 3

It is noted that the container as such is designed to contain content. Such content is placed inside the container 1 during production of the container, and typically prior to folding the flaps forming the top panel 6 or bottom panel 2. The content to be contained may be stored in pouch and such a pouch is placed in the container prior to forming the top panel 6 and/or bottom panel 2.

Figure 8:
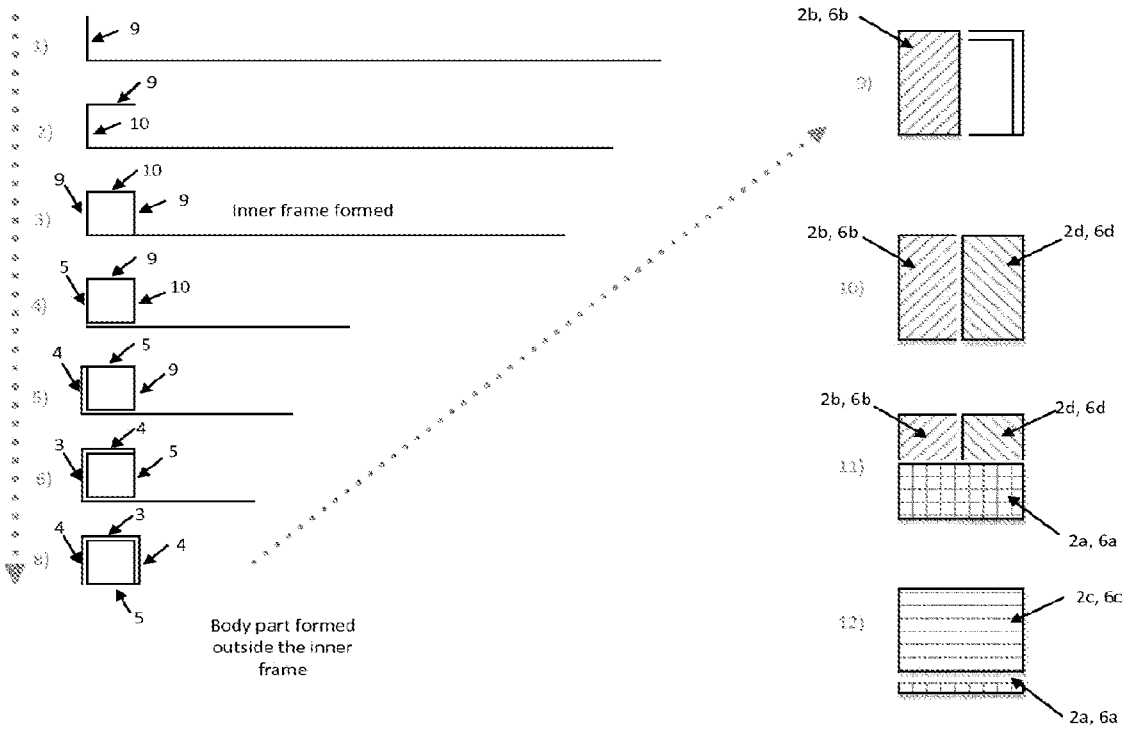
FIG. 8 is a schematic illustration of steps involved in folding a blank into a container according to a preferred embodiment; the right hand side of FIG. 8 is shown in a larger scale that the left hand side of the figure.

FIG. 8 is a schematic illustration of steps involved in folding a blank into a container according to a preferred embodiment. The left hand side of FIG. 8 which shows eight folding steps labelled 1) . . . 8) is drawn in a first scale and the right hand side of FIG. 8 which shows folding steps 9)-12) is drawn in larger scale in order to render the folding of the flaps more clearly identifiable. The box is seen in a cross sectional view at the left hand side and from the bottom or top in the right hand side. Further, please note that the gluing steps have not been indicated in FIG. 8 and that such gluing (adherence steps in general) are applied as outlined above. In addition, the step of folding of flap 12 has also been left out from FIG. 8. Such folding of flap 12 may be carried out a first step prior to step 1).

As illustrated in FIG. 8, the folding may be commenced (step 1) by folding the blank 90° at the folding line between the outer most (as seen from the blank) inner side part 9 and inner front part 10. Thereby the inner side part extends transverse to remaining part of the blank which is kept horizontal. At step 2, the blank is folded 90° at the folding line between inner front part 10 and the inner side part 9 connected to the intermediate part 20. At step 3, the blank is folded 90° at the folding line between the intermediate part 20 and the rear panel 5. As illustrated this folding is continued until the outer body part of the container is formed outside the inner frame.

It is seen from the illustration of FIG. 8 that the folding of the container inter alia resides in that the part of the blank not yet folded in the sequence of folding steps may be kept horizontal and that the folding process may be carried out as a sequence of steps in a horizontal folding machine thereby allowing for a very fast and efficient folding process.

In a preferred embodiment, the container is pre-folded prior to arranging content inside the container. By pre-folded it is meant that the inner frame and outer body of the container are provided with the flap 12 folded and the flap part 12' adhered to the inner side of the front panel 3. Thus, the container has accordingly the shape of a tubular element with open end, the flaps 6*a*, 6*b*, 6*c*, 6*d*, 2*a*, 2*b*, 2*c* and 2*d* being unfolded (as disclosed in FIG. 8; step 8)

In order to provide a package ready for e.g. end-consumers, a preferred embodiment of the invention may comprise the steps of arranging content into a container produced as described above from a blank according to present invention.

Subsequently, folding of the flaps 6*a*, 6*b*, 6*c*, 6*d* and/or 2*a*, 2*b*, 2*c*, 2*d* along the folding lines to form a bottom panel 2 and/or a top panel 6 of the container, and adhering (such as gluing) together the two outer most flaps of respectively the bottom panel 2 and top panel 6.

It is noted that it may be advantageous to form the bottom panel 2 or the top panel 6 prior to arranging the content in the pre-folded container, and that this is considered within the scope of the present invention.

The content being arranged in the container is preferably contained in a pouch which is arranged in the container. Such a pouch may contain a powder product which is arranged in the pouch prior to sealing of the pouch.

In order to prevent the pouch from possibly inflicting the easy reclosing of the container, the pouch is typically provided with such dimensions that its horizontal extension is smaller than the distance from the bottom panel 2 of the container 1 and to the lower most position of the upper margin of each of the inner side parts 9 and, the outer shape of the pouch, when filled with a product, mimics the internal geometry of the container 1.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A blank for a flip-top container, the blank comprising a section for an outer body part and a section for an inner frame, wherein:

the section of the blank for the outer body comprises two side panels, a front panel and a rear panel, each side panel is connected to the front panel at opposite vertical folding lines, the rear panel is connected to one of the side panels along a vertical folding line, each of the side panels, the front panel and the rear panel has a flap connected at an upper horizontal folding line and at a lower horizontal folding line of the corresponding panel, and a first scoring line is provided in the side panels and in the front panel, the section of the blank for the inner frame comprises two inner side parts and an inner front part, each of the inner side parts is connected to the inner front part at opposite vertical folding lines, the inner front part comprises a flap connected at an upper horizontal folding line, the first scoring line extends downwardly sloping in the side panel towards the front panel and extends horizontally in at least a part of the front panel, the blank further comprises an intermediate part connected to one of the inner side parts and to the rear panel along a vertical folding line, the flap of the inner front part comprises a second scoring line, the second scoring line extending horizontally across the flap of the inner front part and defining a horizontal flap part above the second scoring line and another horizontal flap part connected to the inner front part through the horizontal folding line, upper margins of the inner side parts extend downwardly sloping from the vertical folding lines at which the inner side parts are connected to the inner front part, and the blank is configured such that when the blank is folded into the flip-top container, only an upper-most part of each of the upper margins of the inner side parts extends above the first scoring line in the side panels, the container is configured to have a first stage of a closing operation and then a second stage in which a portion of the front panel above the first scoring line meets the inner front part, the upper margins of the inner side parts extend downwardly sloping toward the rear panel to prevent engagement of (i) portions of the side panels above the first scoring line with (ii) the inner side parts during the closing operation, the blank has at least one feature selected from the group consisting of (a) the upper margins of the inner side parts are configured to guide the portions of the side panels above the first scoring line outwardly during the first stage of the closing operation and (b) the portions of the side panels above the first scoring line are configured to guide the inner side parts inwardly during the first stage of the closing operation, and when the closing operation is at the second stage, the flap of the inner front part extends outwardly and downwardly to guide the portion of the front panel above the first scoring line outwardly and/or guide the inner front part inwardly.

2. The blank according to claim 1, wherein a horizontal folding line is provided in the rear panel.

3. The blank according to claim 2, wherein the horizontal folding line extends horizontally between the vertical folding lines at which the rear panel is connected to a first side panel of the side panels and the intermediate part, and extends horizontally from an intersection of the first scoring line of the first side panel with the horizontal folding line.

4. The blank according to claim 1, wherein the flap is a trapezoid shape, a shorter horizontal line of the trapezoid shape defining an outer edge of the blank.

5. The blank according to claim 1, wherein the blank is flat.

6. The blank according to claim 1, wherein the blank is made of cardboard.

7. The blank according to claim 1, wherein at least two parallel and spaced apart transverse cuts are provided at or near a central part of the horizontal folding line in the rear panel, the transverse cuts perforating the rear panel through a thickness of the rear panel, and the transverse cuts extending substantially symmetrically across and perpendicular to the horizontal folding line.

8. The blank according to claim 1, wherein each of the first and second scoring lines in the side panels is a row of perforations each comprising two coherent first and second cuts with a blunt angle positioned between the first and second cuts, the perforations arranged to provide a row of tooth-shaped regions, where each tooth-shaped region is defined by a first cut and a second cut, respectively, from two mutually adjacent and non-coherent perforations, and the first cuts are arranged parallel to each other and staggered so that they are not arranged along a single line.

9. A method of producing a blank for a flip-top container, the blank comprising a section for an outer body part and a section for an inner frame, wherein:

the section of the blank for the outer body comprises two side panels, a front panel and a rear panel, each side panel is connected to the front panel at opposite vertical folding lines, the rear panel is connected to one of the side panels along a vertical folding line, each of the side panels, the front panel and the rear panel has a flap connected at an upper horizontal folding line and at a lower horizontal folding line of the corresponding panel, and a first scoring line is provided in the side panels and in the front panel, the section of the blank for the inner frame comprises two inner side parts and an inner front part, the container is configured to have a first stage of a closing operation and then a second stage in which a portion of the front panel above the first scoring line meets the inner front part, each of the inner side parts is connected to the inner front part at opposite vertical folding lines, the inner front part comprises a flap connected at an upper horizontal folding line, the first scoring line extends downwardly sloping in the side panel towards the front panel and extends horizontally in at least a part of the front panel, the blank further comprises an intermediate part connected to one of the inner side parts and to the rear panel along a vertical folding line, the flap of the inner front part comprises a second scoring line, the second scoring line extending horizontally across the flap of the inner front part and defining a horizontal flap part above the second scoring line and another horizontal flap part connected to the inner front part through the horizontal folding line, upper margins of the inner side parts extend downwardly sloping from the vertical folding lines at which the inner side parts are connected to the inner front part, and the blank is configured such that when the blank is folded into the flip-top container, only an upper-most part of each of the upper margins of the inner side parts extends above the first scoring line in the side panels, the upper margins of the inner side parts extend downwardly sloping toward the rear panel to prevent engagement of (i) portions of the side panels above the first scoring line with (ii) the inner side parts during the closing operation, the blank has at least one feature selected from the group consisting of (a) the upper margins of the inner side parts are configured to guide the portions of the side panels above the first scoring line outwardly during the first stage of the closing operation and (b) the portions of the side panels above the first scoring line are configured to guide the inner side parts inwardly during the first stage of the closing operation, and when the closing operation is at the second stage, the flap of the inner front part extends outwardly and downwardly to guide the portion of the front panel above the first scoring line outwardly and/or guide the inner front part inwardly, the method comprising:

providing a sheet of material having an outer size larger than an outer contour of the blank;

cutting the outer contour of the blank from the sheet of material;

embossing the upper horizontal folding line and the lower horizontal folding line to the blank; and cutting the first and second scoring lines into the blank.

10. A method of producing a content containing container, the method comprising:

providing a blank, the blank comprising a section for an outer body part and a section for an inner frame, wherein:

the section of the blank for the outer body comprises two side panels, a front panel and a rear panel, each side panel is connected to the front panel at opposite vertical folding lines, the rear panel is connected to one of the side panels along a vertical folding line, each of the side panels, the front panel and the rear panel has a flap connected at an upper horizontal folding line and at a lower horizontal folding line of the corresponding panel, and a first scoring line is provided in the side panels and in the front panel, the section of the blank for the inner frame comprises two inner side parts and an inner front part, the container is configured to have a first stage of a closing operation and then a second stage in which a portion of the front panel above the first scoring line meets the inner front part, each of the inner side parts is connected to the inner front part at opposite vertical folding lines, the inner front part comprises a flap connected at an upper horizontal folding line, the first scoring line extends downwardly sloping in the side panel towards the front panel and extends horizontally in at least a part of the front panel, the blank further comprises an intermediate part connected to one of the inner side parts and to the rear panel along a vertical folding line, the flap of the inner front part comprises a second scoring line, the second scoring line extending horizontally across the flap of the inner front part and defining a horizontal flap part above the second scoring line and another horizontal flap part connected to the inner front part through the horizontal folding line, upper margins of the inner side parts extend downwardly sloping from the vertical folding lines at which the inner side parts are connected to the inner front part, and the blank is configured such that when the blank is folded into the flip-top container, only an upper-most part of each of the upper margins of the inner side parts extends above the first scoring line in the side panels, the upper margins of the inner side parts extend downwardly sloping toward the rear panel to prevent engagement of (i) portions of the side panels above the first scoring line with (ii) the inner side parts during the closing operation, the blank has at least one feature selected from the group consisting of (a) the upper margins of the inner side parts are configured to guide the portions of the side panels above the first scoring line outwardly during the first stage of the closing operation and (b) the portions of the side panels above the first scoring line are configured to guide the inner side parts inwardly during the first stage of the closing operation, and when the closing operation is at the second stage, the flap of the inner front part extends outwardly and downwardly to guide the portion of the front panel above the first scoring line outwardly and/or guide the inner front part inwardly;

folding the inner frame by folding along the vertical folding lines where each of the inner side parts are connected to the inner front part by an amount of 90°;

folding the flap 180° along a folding line along which the flap is connected to the inner front part;

folding the section for an outer body part, around the folded inner frame by folding, by an amount of 90° along the vertical folding lines of the section for an outer body part;

adhering the side panel forming an outer margin of the blank to the intermediate part and adhering at least a section of the flap to an inner surface of the front panel;

arranging the content into the content containing container produced from the blank, the blank is folded to form the outer body part and the inner frame, with the flaps of each of the side panels, the front panel and the rear panel being unfolded, and the flap of the inner front part being folded 180° along the upper horizontal folding line along which the flap is connected to the inner front part and adhered to the inner surface of the front panel; and folding the flaps along the upper horizontal and the lower horizontal folding lines to form a bottom panel and a top panel of the content carrying container, and adhering a first outer most flap to a second outermost flap of each of the bottom panel and the top panel together, respectively.

* * * * *